US005448280A

United States Patent [19]

Matsuda et al.

[11] Patent Number: 5,448,280

[45] Date of Patent: Sep. 5, 1995

[54] REWRITEABLE CARD, PRINTING APPARATUS FOR PRINTING THE CARD AND A METHOD OF JUDGING THE LIFE OF THE SAME

[75] Inventors: Hideaki Matsuda; Shigeru Tazawa, both of Miyagi, Japan

[73] Assignee: Tohoku Ricoh Co., Ltd., Miyagi, Japan

[21] Appl. No.: 345,432

[22] Filed: Nov. 21, 1994

Related U.S. Application Data

[62] Division of Ser. No. 158,499, Nov. 29, 1993, abandoned.

[30] Foreign Application Priority Data

Nov. 30, 1992 [JP] Japan ..... 4-321025
Nov. 30, 1992 [JP] Japan ..... 4-321026

[51] Int. Cl.[6] ..... B41M 5/00

[52] U.S. Cl. ..... 347/171; 356/433; 356/448; 347/221

[58] Field of Search ..... 346/76 PH, 135.1, 76 R, 346/76 L, 108; 359/36, 43, 44, 45; 356/432, 433, 434, 435, 445, 448; 347/221, 171

[56] References Cited

U.S. PATENT DOCUMENTS 5,274,460 12/1993 Yamada ..... 358/296
5,371,522 12/1994 Miyawaki et al. ..... 346/76 PH

FOREIGN PATENT DOCUMENTS 250897 2/1990 Japan .

*Primary Examiner*—Huan H. Tran
*Attorney, Agent, or Firm*—Armstrong, Westerman, Hattori, McLeland and Naughton

[57] ABSTRACT

A rewriteable card of the invention is composed of a thermally reversible thermosensitive recording material which changes reversibly between a slightly opaque state and a transparent state depending on a given heating condition wherein the rewriteable card includes a reference slightly opaque portion at the part thereof having the reflectance equivalent to a slight opacity state of the thermally reversible thermosensitive recording material in an early stage or a last stage of use of the rewriteable card. A method of judging the life of the rewriteable card is based on the result of detection of the reflectance on a printing slightly opaque portion and that on the reference slightly opaque portion, and a printing apparatus is provided with a card life judging device employing the judging method.

2 Claims, 9 Drawing Sheets

REWRITEABLE CARD, PRINTING APPARATUS FOR PRINTING THE CARD AND A METHOD OF JUDGING THE LIFE OF THE SAME

This is a division of application Ser. No. 08/158,499 filed Nov. 29, 1993 abandoned.

BACKGROUND OF THE INVENTION

1. Field of the Invention

This invention relates to a card which makes use of a thermally reversible thermosensitive recording material whereby data information can be rewritten in the card repeatedly (hereinafter referred to simply as "rewriteable card") and also to a printing apparatus for printing the card and a method for judging the life thereof.

2. Description of the Prior Art

In recent years, a specific type of card called rewriteable card has been employed, as a pre-paid card, in the field of various pastimes or services. The rewriteable card ordinarily makes use of a thermosensitive recording material which is a kind of composite material consisting of high molecular weight and low molecular weight materials, by which data information can be erased and rewritten repeatedly.

When the thermally reversible thermosensitive recording material used as the rewriteable card is heated to a predetermined level of temperature, it changes from a transparent state to a slight opaque state. When the material is heated to another level of temperature, it changes from the slightly opaque state to the transparent state. At normal temperature, the material keeps either of the states as it is. In the rewriteable card, printed information can be erased and rewritten a desired number of times by application of appropriate heat energies.

The rewriteable card may comprise a base color layer, such as an aluminum thin sheet, added to an intermediate layer portion of a card structure. By this, the base color of the layer can be seen through the transparent portion of the thermosensitive recording material, thereby increasing a contrast ratio to the slightly opaque portion to make clearer print.

A printing apparatus provided with a thermal head which can print the rewriteable card. Used rewriteable card can be collected and recycled by changing its data information, which is very useful in view of the effective utilization of resources.

However, since the rewriteable card is recycled by repeatedly erasing and rewriting the printed information, the density of slight opacity of the slight opaque portion is gradually lowered as the number of times of the erasing and rewriting of the printed information is increased. As a result, the transparent portion remains on the portion which must be the slight opaque portion originally so that the base color can be seen through the transparent portion, thereby decreasing the contrast ratio between the original slight opaque portion and the base color portion.

If the printed information comprises the one which is visible by human eyes such as letters and/or numerals, the rewriteable card can be used without any trouble even if the contrast ratio is decreased when the base color is black.

However, if the data information comprises the one such as a bar code, etc. which can be recognized by an electro-optical technique, there is a possibility that a reader such as a bar code reader can not read the bar code, etc., or erroneously reads. As a result, there was the possibility that a system employing the bar code, etc., had not functioned as a whole.

The rewriteable card is liable to have a flaw on its surface caused by the contact with the thermal head during printing or by the repeated use thereof, which results in generation of the problem that the printed information such as the bar code, etc., is liable to be defective.

SUMMARY OF THE INVENTION

It is an object of the invention to solve the problems as mentioned hereinabove.

That is, it is an object of the invention to accurately judge the life of a rewriteable card printed information of which can be erased and rewritten repeatedly using a thermally reversible thermosensitive recording material.

Another object of the invention is to accurately judge the decrease of the contrast ratio between the slight opaque portion, which is deteriorated by the increase of the number of repeated printing times on the rewriteable card, and a transparent base color portion other than the slight opaque portion on the rewriteable card, whereby the life of the rewriteable card can be judged and consequently only the rewriteable card, printed information of which can be surely read by an electro-optical reader, can be issued.

Further object of the invention is to accurately judge an inferior card having a flaw on the surface thereof or a defective printed information which is caused by omission of dot or generation of void spot even if it is before the reversibility characteristics of the thermally reversible thermosensitive recording material has expired.

Still further object of the invention is to enable an operator to check the inferior card at a glance so that the inferior card can be easily sorted from a normal card.

More further object of the invention is to automatically prepare a rewriteable card having the same printed information as that of the inferior card even if the inferior card is issued so as to save an operator's trouble involved in reprinting the information, on a new rewriteable card, which is the same as that appeared on the inferior card upon completion of the printing even if the inferior card is issued.

Still more further object of the invention is to discriminate the cause of the generation of the inferior card, namely, it is caused by the life of the thermally reversible thermosensitive recording material used as the rewriteable card or by the defect of the printed information due to the flaw on the surface of the rewriteable card when the inferior card is issued.

Other object of the invention is to recycle the rewriteable card usefully until the expiration of its life.

To achieve the above objects, the rewriteable card composed of a thermally reversible thermosensitive recording material which changes reversibly between a slightly opaque state and a transparent state depending on a given heating condition is characterized in including a reference slightly opaque portion. The reference slightly opaque portion has the same reflectance as the slight opacity of the thermally reversible thermosensitive recording material in the early stage of use or in the last stage of use the rewriteable card where the life of the thermally reversible properties of the thermally reversible thermosensitive recording material, described later, will soon expire, (hereinafter referred to simply as "last stage of use of the card").

Such a rewriteable card, the degree of slight opacity of the slightly opaque portion in the printing area (the portion where the rewriteable card is made slightly opaque by heating) is gradually lowered when it is recycled by erasing and rewriting the data information repeatedly. On the other hand, the reference slightly opaque portion keeps to have the same reflectance as equivalent to the slight opacity of the thermally reversible thermosensitive recording material in its early or last stage of use of the same. If the reflectance of the reference slightly opaque portion is compared with that of the printing slightly opaque portion where the degree of slight opacity is lowered, it is possible to judge that the life of the thermally reversible thermosensitive recording material has expired or not.

The printing apparatus of the invention comprises a carriage means for carrying the rewriteable card along a carriage route of the rewriteable card, a printing means disposed on the carriage route to apply appropriate heat energies to the rewriteable card to thereby make the thermally reversible thermosensitive recording material slightly opaque, a reference slightly opaque portion detecting means for detecting the reflectance of the reference slightly opaque portion representing slight opacity of the rewriteable card in the early stage of use or the last stage of use of the rewriteable card, a printing slightly opaque portion detecting means for detecting the reflectance of the printing slightly opaque portion printed by the printing means and a thermally reversible properties life judging means for judging the life of the thermally reversible properties of the thermally reversible thermosensitive recording material based on the result of judgement of the reference slightly opaque portion detecting means and the result of judgment of the printing slightly opaque portion detecting means.

With such an arrangement of the printing apparatus, it is possible to accurately judge the limit of use of the rewriteable card since the printing slight opaque portion detecting means detects the reflectance of the printing slight opaque portion of the rewriteable card, compares it with the reflectance of the reference slight opaque portion and judges that the thermally reversible thermosensitive recording material expired in its thermally reversible properties when the difference of reflectance therebetween reaches a given value.

The printing apparatus of the invention can be provided with a reprinting control means for allowing the printing means to print the same data information on the rewriteable card to be printed next, as the printed information of an inferior card life of which is judged to have expired by the thermally reversible properties life judging means. It is also possible to provide an invalid index forming means for printing an invalid index on the inferior card life of which has expired.

Furthermore, the printing apparatus of the invention can be provided with a verification means for verifying the printed information such as a bar code, etc. which is printed on the rewriteable card. It is also possible to provide a reprinting control means for allowing the printing means to print the same data information, on the rewriteable card to be printed next, as the printed information of the inferior card and an invalid index forming means for printing an invalid index on the inferior card when the verifying means detected the inferior card having the detective printed information.

With the provision of such a verification means, the verification means judges the inferior card having the defective printed information thereon, which results in prevention of the issuance of such the inferior card. For example, the verification means can detect the rewriteable card having the flaw on the bar code portion of the printing portion even if it is before the life of the thermally reversible properties of the thermally reversible thermosensitive recording material has expired.

The printing apparatus of the invention can be further provided with a card life deciding means for judging the life of the rewriteable card based on the result of judgment of the thermally reversible properties life judging means and the result of verification of the verification means. In such an arrangement, the reprinting control means and the invalid index forming means can be controlled by the result of judgment of the card life deciding means. With such an arrangement of the printing apparatus, the rewriteable card can be recycled usefully until its life expires.

Since the printing apparatus is provided with the reprinting control means, it automatically prints the same data information, on the rewriteable card to be printed next, as the printed information of the card which was judged as inferior card by the thermally reversible properties life judging means or by the verification means, which results in saving the operator's trouble involved in checking the inferior card and repreparing the rewriteable card upon completion of the printing.

Since the printing apparatus is provided with the invalid index forming means, the invalid index forming means can form an invalid index by printing, etc. on the rewriteable card life of which has expired or the rewriteable card having the defective printed information so that the operator can easily check and remove the inferior card.

The printing apparatus of the invention can be provided with an invalid index change control means for changing the mode of the invalid index to be formed by said invalid index forming means based on the result of judgment of the thermally reversible properties life judging means, or by the result of verification by the verification means 70 or by the result of combination of both the judgment of the thermally reversible properties life judging means and the verification by the verification means 70.

With the provision of the invalid index change control means, it is possible to form different invalid indexes on the rewriteable card depending on the cause of generation of the inferior card, namely, the defect is caused by the expiration of life of the thermally reversible properties of the thermal reversible thermosensitive recording material used as the rewriteable card, or by other factors such as by the flaw, etc. on the bar cord, etc. of the rewriteable card. As a result, the causes of generation of the inferior rewriteable card can be easily discriminated by each factor.

A method of judging the life of the rewriteable card composed of the thermally reversible thermosensitive recording material which changes reversible between the slightly opaque state and the transparent state depending on a given heating condition is characterized in comprising comparing the reflectance of the reference slightly opaque portion representing slight opacity of the rewriteable card in the early or last stage of the rewriteable card with that of the printing slightly opaque portion which is made slightly opaque when appropriate heat energies are applied to the rewriteable card to thereby judge the life of the thermally reversible properties of the thermal reversible thermosensitive recording material.

The method of judging the life of the rewriteable card may further comprise verifying the data information printed on the rewriteable card has a defect or not and detecting the defect of the printed information whereby the life of the rewriteable card is judged to have expired.

The above and other objects, features and advantages of the invention will be apparent from the following detailed description which is to be read in conjunction with the accompanying drawings.

DETAILED DESCRIPTION OF THE PREFERRED EMBODIMENT

A preferred embodiment of the invention will be described with reference to the attached drawings.

Figure 1:
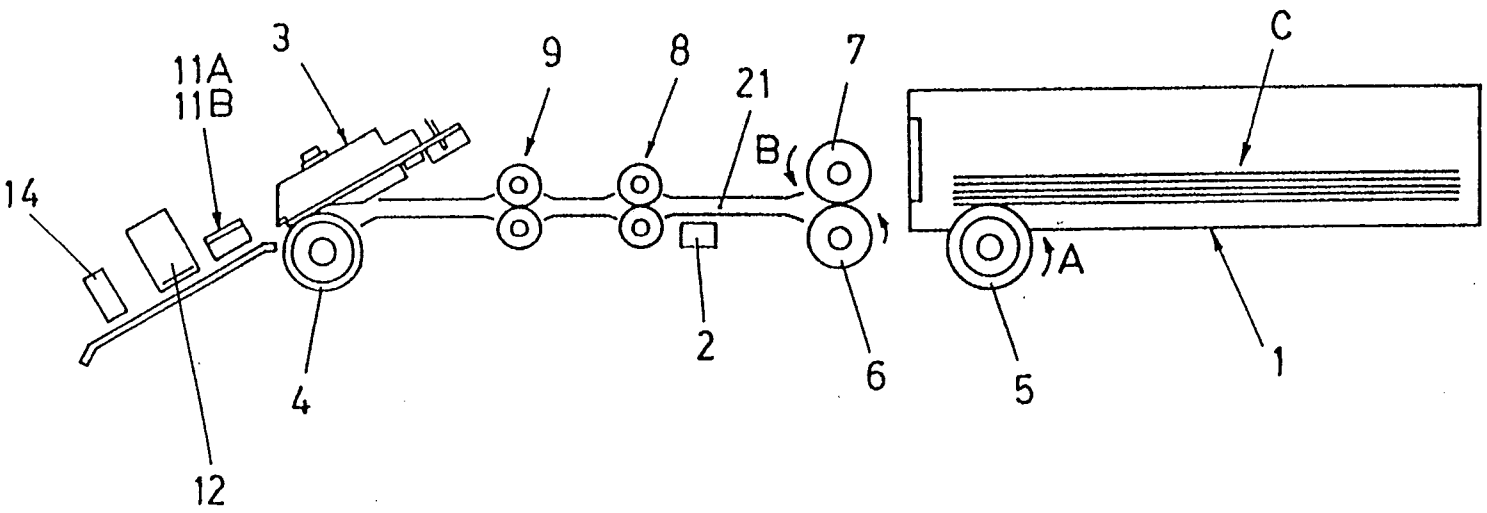
FIG. 1 is a schematic view showing the arrangement of a printing apparatus according to an embodiment of the invention.
Figure 2:
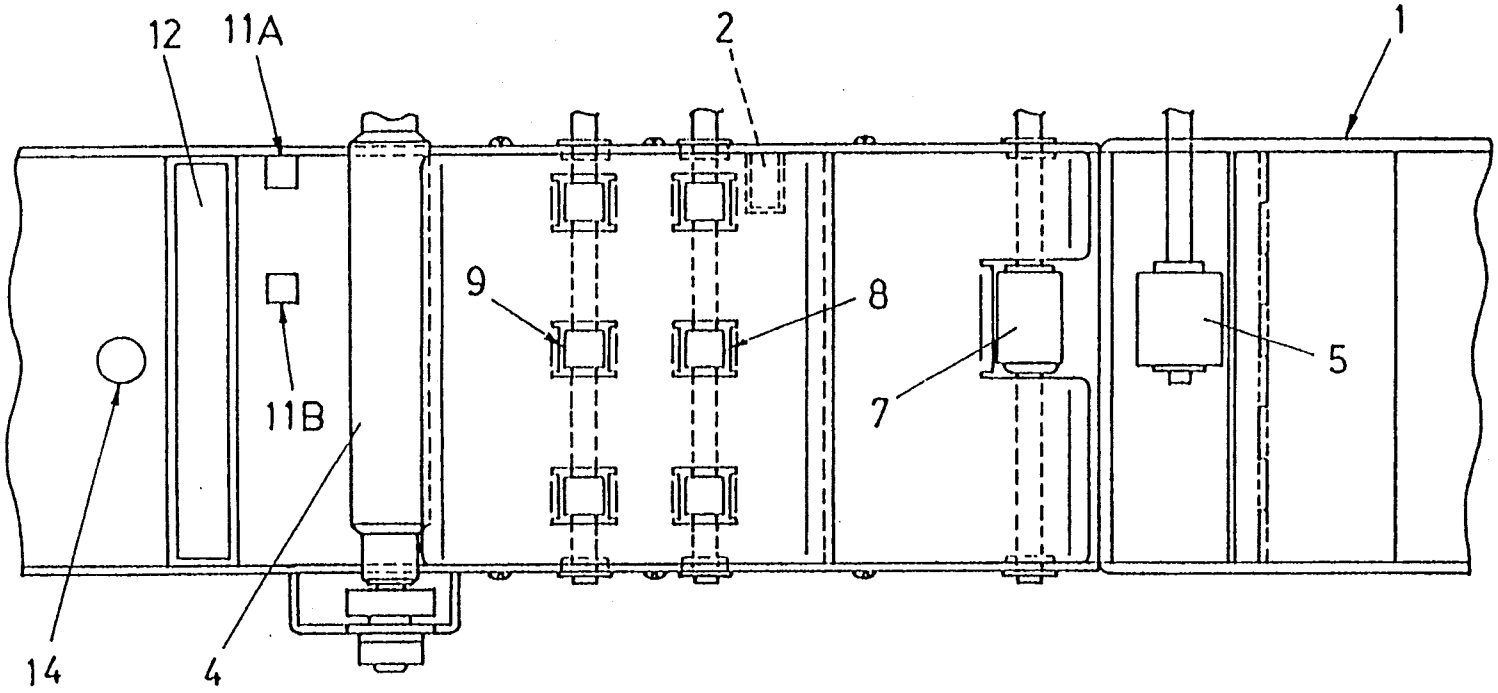
FIG. 2 is a plan view of the printing apparatus of FIG. 1.

As illustrated in FIGS. 1 and 2, the printing apparatus of the invention is an apparatus for printing a card C composed of a thermally reversible thermosensitive recording material which changes reversibly between an slightly opaque state and a transparent state depending on a given heating condition (hereinafter referred to as simply "card"). That is, a thermal head 3 as a printing means of the printing apparatus, applies appropriate printing energies to the card so as to heat the card to a printing temperature so that the card is made slightly opaque.

The cards C are stacked and stored in a cassette case 1 and they are fed one by one from the cassette case 1 to a carriage route 21. A reverse roller 7 and a feed roller 6 which are confronted and brought into contact with each other in the vertical direction, a card sensor 2 for detecting the card C which travels on the carriage route 21, a carriage roller pair 8 and 9 are respectively disposed on the carriage route 21 between the cassette case 1 and the thermal head 3 in this order from upstream to downstream. The distance between and the number of the carriage roller pair 8 and 9 are properly determined depending on the length of the carriage route 21 and the length of the card C in the carrying direction. The thermal head 3 contacts a platen 4 at a given pressing force which is adapted for printing the printing portion.

First and second detecting sensors 11A and 11B (hereinafter referred to as "sensors") respectively formed of reflecting photosensors, a verification unit 12 for verifying the information printed on the card C and a void stamper 14 as an invalid index forming means are respectively disposed understream the thermal head 3. There is provided a discharge tray, not shown, at the distal end of the carriage route 21 for accommodating the printed card C.

The card sensor 2 may be any type if it can detect the card C traveling on the carriage route 21, for example, an optical sensor such as a reflecting photosensor, transmission type photosensor, etc. or a mechanical sensor.

The first sensors 11A as illustrated in FIG. 2 constitutes one of the components of a reference slightly opaque detecting means for detecting the reflectance of the reference slightly opaque portion formed on the card C, described later. The second sensor 11B constitutes one of the components of a print slightly opaque detecting means for detecting the reflectance of the slightly opaque portion which is present in the printing portion of the card C.

There is provided a feed roller 5 on the bottom surface of the cassette case 1 which is open downward at the feeding side of the card C. The card C accommodated in the cassette case 1 is fed by rotating the feed roller 5 in the direction of the arrow A in FIG. 1. That is, the card C is fed sequentially leftward in FIG. 1 from the lower side in the cassette case 1. The thus fed card C is carried further leftward in the same figure by the feed roller 6. At this time, the cards C other than the one which is positioned at the lowest in the cassette case 1 are biased in the direction opposition to the feeding direction by the reverse roller 7 which is turned in the direction of the arrow B whereby these cards C are returned to the cassette case 1. As a result, the cards C are separated and fed one by one.

That is, the reverse roller 7 is confronted with and disposed over the feed roller 6 and the turning force in the direction of the B is transmitted to the reverse roller 7 from a driving system by way of a clutch (torque limiter) until the reverse roller 7 receives a given amount of load. Accordingly, when two or more cards C are held between the feed roller 6 and the reverse roller 7, the card C contacting the reverse roller 7 is returned to the cassette case 1.

When a single card C is held between the feed roller 6 and the reverse roller 7, the turning force of the feed roller 6 is transmitted to the reverse roller 7 by way of the card C as a large load so that the clutch is released.

As a result, the reverse roller 7 follows the feed roller 6 and turns so as to carry the card C toward the printing portion positioned at the thermal head 3.

The card C fed from the cassette 1 is carried on the carriage route 21 between the thermal head 3 and the platen 4 and a given printing is performed on the card C when it reaches the thermal head 3. Successively, the card C is further carried and discharged into the discharge tray, not shown. The feed roller 6 for feeding the card C and a carriage motor, not shown, for rotating the platen 4, etc. serve as the carriage means.

The card C of the invention will be described more in detail with reference to FIGS. 3 to 5.

Figure 3:
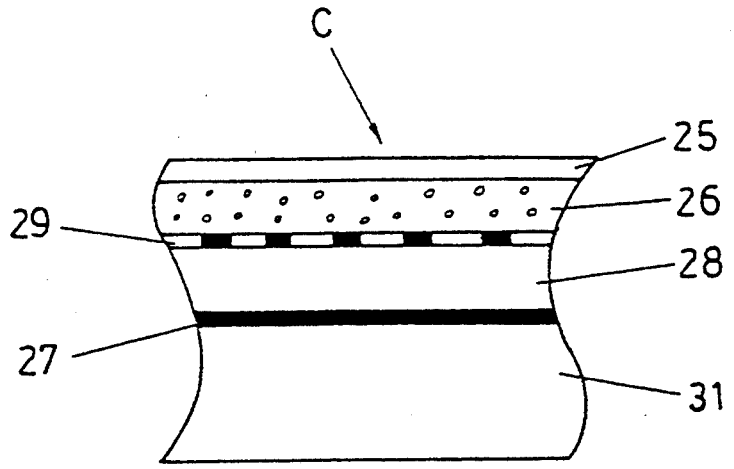
FIG. 3 is a cross sectional view of a rewriteable card according to the embodiment of the invention.

As illustrated in FIG. 3, the card C uses the thermally reversible thermosensitive recording material which is a kind of composite material consisting of high molecular weight and low molecular weight materials as a part thereof and it is a printing medium capable of erasing and rewriting the data information repeatedly due to the thermally reversible properties of this material. The card C comprises a protective layer 25 at the surface which is heated by the thermal head 3, a recording layer 26 disposed under the protective layer 25 and composed of the thermally reversible thermosensitive recording material which is a kind of composite material consisting of high molecular weight and low molecular weight materials as set forth just above, a preprinting portion 29 which is to be printed and disposed under the recording layer 26, a transparent polyester film 28 disposed under the preprinting portion 29, a reflecting layer 27 formed of a black paper, etc. and disposed under the transparent polyester film 28 and a mounting portion 31 disposed under the reflecting layer 27. That is, the card C is formed of a plurality of layers which are layered sequentially in the descending order.

The recording layer 26 is in a transparent state at a normal temperature before printing. Accordingly, the recording layer 26 seems blackish as a whole because the black reflecting layer 27 disposed under the recording layer 26 is seen through the transparent recording layer 26.

If the thermal head 3 is brought into contact with the protective layer 25 of the card C and heated to the printing temperature exceeding 105° C. (writing temperature), the recording layer 26 changes to a middle state between the transparent state and the slightly opaque state at the heated portion. If the recording layer 26 is cooled at a normal temperature, it changes to the slightly opaque state.

Figure 4:
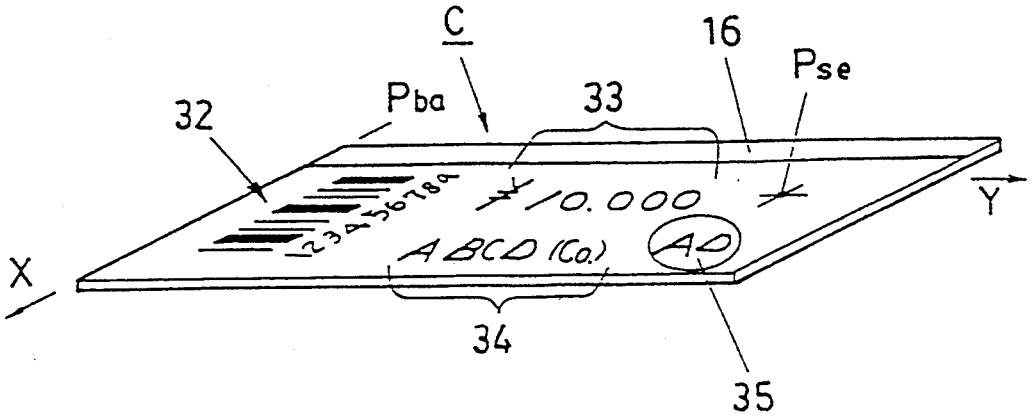
FIG. 4 is an external perspective view of a rewriteable card according to the embodiment of the invention.

Accordingly, for example, as shown in the external appearance of the card C in FIG. 4, if the card C changes from the transparent state to the slightly opaque state by heating the portion other than the bar code 32 or a denomination indicating portion 33, only the bar code 32 and the denomination indicating portion 33 are kept in the transparent state through which the black color of the substrate can be seen.

There are formed printed portions 34 and 35 showing a company name, a mark, etc., which are colored beforehand by printing, etc. on the card C. The printed portions 34 and 35 can be seen from the outside even if the card C changes to the slightly opaque state as a whole when it is heated to the printing temperature where it changes from the transparent state to the slightly opaque state.

A reference slightly opaque portion 16 is provided like a belt along one side edge of the card C, which will be described more in detail later.

The card C changes to the slightly opaque state if it is heated to a given printing temperature and then cooled to the normal temperature. On the other hand, if the card C is reheated to a given erasing temperature (e.g. 76° C. to 98° C.), the slightly opaque portion is returned to the transparent state. This transparent state remains as it is even if the temperature returns to the normal temperature.

In such a manner, the card C composed of the thermally reversible thermosensitive recording material changes from the transparent state to the slightly opaque state when the printing temperature is applied thereto and changes vise versa when the erasing temperature is applied thereto.

Accordingly, if an erasing heater for heating the card C to the erasing temperature is provided on the carriage route 21 between the feed roller 6 and the thermal head 3 and the card C is heated by the erasing heater, the data information printed on the recording layer 26 can be erased before the card C reaches the printing portion.

Even if the erasing heater is not provided on the carriage route 21, the cards C can be erased as a whole by heating the collected cards C to the erasing temperature by a heating means such as a constant-temperature tank, etc.

The card C can function to hold the data information magnetically if a magnetic layer is provided between the reflecting layer 27 and the mounting portion 31 as illustrated in FIG. 3.

The data information can be repeatedly erased from and rewritten in the card C whereby the data information can be changed. The data information is written in the card C by bringing the thermal head 3 into contact with the protective layer 25. Accordingly, in case of printing the card C by the printing apparatus as illustrated in FIG. 1, the protective layer 25 of the card C needs to direct upward and be accommodated in the cassette case 1 considering the directions of the bar code 32 and the denomination indicating portion 33 of the printed portions 34 and 35 (refer to FIG. 4).

The thermal reversible properties of the thermally reversible thermosensitive recording material is deteriorated as the repeated number of times of erasing and rewriting of the data information is increased. That is, the card using the thermally reversible thermosensitive recording material does not change from the transparent state to the slight opaque state as well when it is recycled multiple times, due to rewriting of the data information. As a result, the base color can be seen through the transparent portion so that the contrast ratio to the base color is decreased. Furthermore, it is inevitable that the card is liable to be contaminated or injured at the surface thereof by repeated printing. There is a possibility that the card, which has been repeatedly used many times, has such a defect that the printed information on such a card can be neither recognized by human eyes nor read by an electro-optical reader if the printed information is a bar code, etc.

Comparing the deterioration of the slight opaque portion in the early stage with that in the last stage in respect of actually measured optical density (hereinafter referred to as "O.D."), it revealed that the O.D. was about 0.55 at the early stage while the O.D. was about 0.60 at the last stage. That is, the difference of the O.D. between the early and last stages is very slight, i.e., 0.05.

There is provided a reference slight opaque portion 16 on the card C to correctly judge such a slight difference of the O.D. as illustrated in FIG. 4. This is described more in detail with reference to FIG. 5 which illustrates simply the printed information of the card for the explanation convenience.

Figure 5:
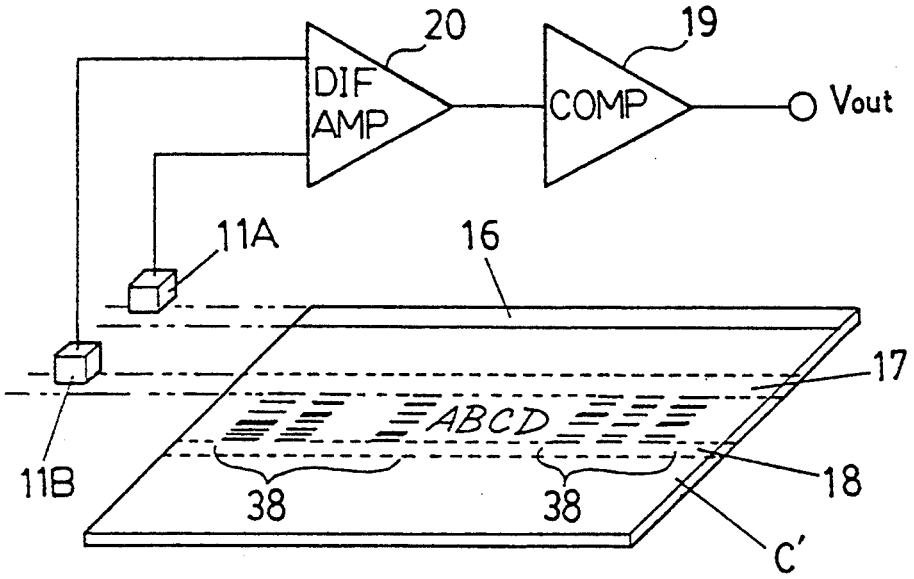
FIG. 5 is a perspective view showing the rewriteable card and a thermally reversible properties life judging means of the printing apparatus according to the embodiment of the invention.

A card C′ as illustrated in FIG. 5 has the reference slight opaque portion 16 which is printed at one end side of the protective layer 25 (at the heating side) of the card C in the entire length thereof in the carrying direction as illustrated in FIG. 3. There are provided a bar code forming regions in the central portion of the card C′ in the width direction traversing to the carrying direction at right angles for forming bar codes 38 continuously. Quiet zones 17 and 18 are provided on both sides of the bar code forming region in the carrying direction of the card C′ in the entire length of the card C′. The quiet zones 17 and 18 are slight opaque portions (hereinafter referred to as "printing slight opaque portion") when the thermally reversible thermosensitive recording material is heated to the printing temperature.

The reference slight opaque portion 16 is regulated in the O.D. so that it has a reflectance equivalent to slight opacity or the slight opaque state of the thermally reversible thermosensitive recording material in the early stage of the card C′. The reference slight opaque portion 16 is preferable to be formed at the portion where it is not held between the thermal head 3 and the platen 4, because if the reference slight opaque portion 16 is held between the thermal head 3 and platen 4 it wears and is damaged so that the reflectance is liable to change.

The first sensor 11A is disposed at the position where the reference slight opaque portion 16 of the card C′ passes while the second sensor 11B is disposed at the position where the quiet zone 17 passes.

The first sensor 11A receives the light reflected from the reference slight opaque portion 16 and converts the reflected light into a detection voltage and outputs the detection voltage to a differential amplifier 20, described later. On the other hand, the second sensor 11B receives the light reflected from the quiet zone 17 and converts the reflected light into another detection voltage and outputs the detection voltage to the differential amplifier 20. The amount of reflected light received by the first sensor 11A corresponds to the reflectance of the reference slight opaque portion 16 while the amount of reflected light received by the second sensor 11B corresponds to the reflectance of the quiet zone 17. Accordingly, the first sensor 11A outputs the detection voltage corresponding to the reflectance of the reference slight opaque portion 16 while the second sensor 11B outputs the detection voltage corresponding to the reflectance of the quiet zone 17.

Furthermore, the differential amplifier (subtraction circuit) 20 amplifies the slight difference between these detection voltages. Successively, the output of the differential amplifier 20 is compared with a predetermined threshold voltage by the comparator 19 to thereby obtain a life judging signal Vout. The differential amplifier 20 and the comparator 19 are constituents of a thermally reversible properties life judging means for judging the life of the thermally reversible properties of the thermally reversible thermosensitive recording material. In case of using the card C as illustrated in FIG. 4, the life of the thermally reversible thermosensitive recording material can be judged based on the difference of the O.D. (reflectance obtained thereby) between the reference slight opaque portion 16 and the printing slight opaque portion. However, there are provided the printed portions 34 and 35 in the card C as illustrated in FIG. 4, it is impossible to provide the printing slight opaque portion in the entire length of the card in the carrying direction of the card like the quiet zones 17 and 18 of the card C′ as illustrated in FIG. 5.

Accordingly, the portion which is suitable for the printing slight opaque portion is selected on the card C as illustrated in FIG. 4 and the second sensor 11B is disposed on the X coordinate of the selected printing slight opaque portion. An origin is positioned on a prescribed base line Pba (the tip end of the card in the carrying direction) which is set on the card C and a Y coordinate of an arbitrary checking point Pse which is present on the printing slight opaque portion is specified.

The value of the so specified Y coordinate is input into a controller for controlling the carriage system of the card. When the checking point Pse of the card C reaches a checking region where the second sensor 11B performs the detection, the controller stops the carriage of the card C. With such an arrangement, the life of the thermally reversible thermosensitive recording material can be judged based on the difference of the O.D. (reflectance obtained thereby) between the reference slight opaque portion 16 and the printing slight opaque portion.

The rewriteable card may have the following structure in case that the position where the printing slight opaque portion is present is varied depending on the card to be carried or in case that the reference slight opaque portion 16 is not formed in the entire length of the card at a predetermined width in the carrying direction of the card (refer to FIG. 4).

That is, in case that the position where the printing slight opaque portion is present is varied depending on the card, there is provided a second driving means 80 in the printing apparatus for moving the sensor 11B to the arbitrary position in the direction of the X coordinate over the carriage route 21 and locking it at the same arbitrary position is disposed in the printing means. The second driving means 80 is controlled by a sensor driving control means 81 so that the second sensor 11B is moved to the position confronting the printing slight opaque portion of the card to be carried.

The sensor driving means 80 may be structured in a manner that the second sensor 11B is moved by the driving force of a motor along a guide rail provided in the direction of the X coordinate over the carriage route 21.

In case that the reference slight opaque portion having a given width can not be formed on the card in the entire length and in the carrying direction of the card, the reference slight opaque portion is formed at the arbitrary position of the card (this position is defined as a printing prohibition region) and a first sensor driving control means 81 for moving the first sensor 11A is disposed in the printing means. The first driving means 82 is controlled by the sensor driving control means 81 so that the first sensor 11A is moved to the position confronting the reference slight opaque portion of the card to be carried. The structure of the first sensor driving means 82 may be the same as that of the second sensor driving means 80.

A main control portion 40 stores therein the printed information and information of the X and Y coordinates representing the locations of the reference slight opaque portion and the printing slight opaque portion on the card, whereby the first and second sensors 11A and 11B can be moved to the positions confronting the reference slight opaque portion and the printing slight opaque portion.

It is preferable to use a stepper motor as the carriage motor of the card C in order to stop the checking point Pse on the card C, as illustrated in FIG. 4, over the checking region of the second sensor 11B with assurance.

In the printing apparatus as illustrated in FIG. 1, the distance between the card sensor 2 and the printing position on the thermal head 3 and the distance between the printing position on the thermal head 3 and the second sensor 11B are beforehand determined. Accordingly, the checking point Pse can be positioned over the checking region of the second sensor 11B if the stepper motor is driven by the distance corresponding to the distance between the card sensor 2 and the thermal head 3 and the thermal head 3 and the second sensor 11B at the time when the card sensor 2 detected the tip end of the card C and by the distance on the Y coordinate corresponding to the distance between the tip end of the card C and the checking point Pse.

Figure 14:
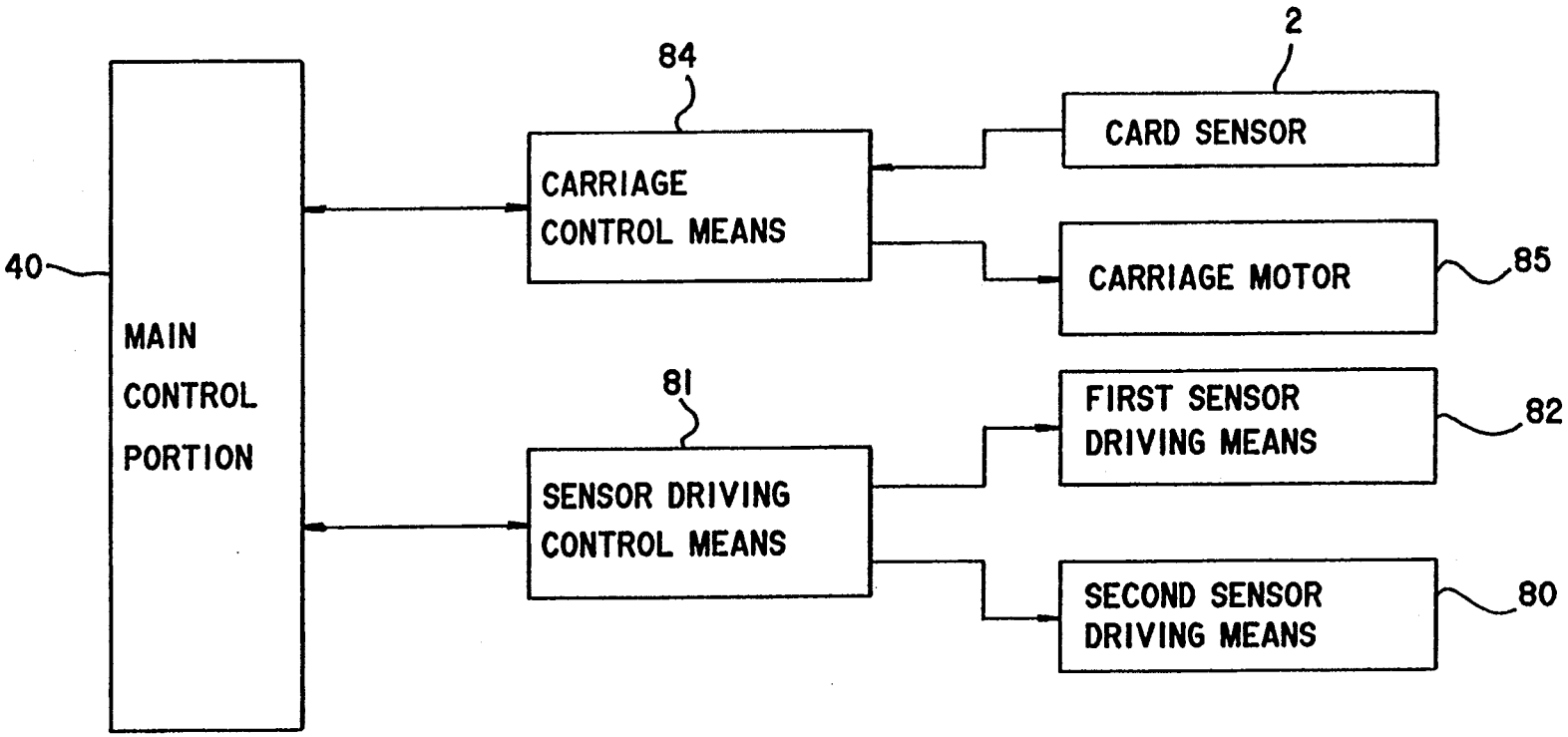
FIG. 14 is a block diagram showing a card carriage mechanism and the driving control system of a sensor of the printing apparatus of FIG. 1.

The driving of the stepper motor can be controlled by, e.g. a carriage control means 84 as illustrated in FIG. 14. The carriage control means 84 receives a distance information between the aforementioned components from the main control portion 40 and a card detection information from the card sensor 2 and drives a stepper motor 85 (carriage motor) based on these information. Likewise, the first and second sensor driving means 82 and 80 can be controlled arbitrarily by stepper motors. If the reference slight opaque portion 16 is disposed on the same surface on the card as the surface (the upper surface in FIG. 3) on which the printing slight opaque portion is disposed, the reflectance of these opaque portions can be compared with each other under the approximate condition. Optical elements of the reflecting photosensor to be used by the first and second sensors 11A and 11B are difficult to be regulated since the variation of the output characteristics of these element is not linear because of the ambient temperature. Accordingly, it is preferable to provide the reference slight opaque portion 16 and the printing slight opaque portion on the same surface of the card where the first and second sensors 11A and 11B detect the reflectance of these opaque portions because the temperature condition is uniform and the detecting accuracy is improved. Furthermore, if the reference slight opaque portion 16 and the printing slight opaque portion are provided on the same surface of the card, there is an advantage that these opaque portions can be observed and compared with each other by the human eyes so that these opaque portions can be judged by the operator to some extent.

The reflectance of the reference slight opaque portion 16 may be the same as that of the printing slight opaque portion in the early or the last stage of use of the card. In this case, the O.D. of the reference slight opaque portion is set to be e.g. 0.59 (experimental value) corresponding to the O.D. in the last stage of use of the card.

In short, if the reference slight opaque portion 16 is formed to match the slight opaque state in the last stage of use of the card and both the opaque portions are formed on the same surface of the card, these opaque portions can be observed and compared with each other more precisely than the case where the observation and the comparison can be made by the human eyes.

A comparison object corresponding to the reference slight opaque portion 16 may be provided in the printing apparatus wherein it is detected by a sensor composed of a reflecting photosensor.

Concrete circuit arrangement of a reference slight opaque portion detecting means, a printing slight opaque portion detecting means and the thermally reversible properties life judging means in the printing apparatus will be described hereinafter with reference to FIG. 6.

The reference slight opaque portion detecting means 22 detects the reflectance of the reference slight opaque portion 16 by the first sensor 11A and the printing slight opaque portion detecting means 23 detects the reflectance of the printing slight opaque portion (quiet zone 17, etc. as illustrated in FIG. 5) by the first sensor 11B.

That is, the reference slight opaque portion detecting means 22 includes the first sensor 11A which is provided with a light emitting element LED1 such as a light emitting diode, etc. The light emitting element LED1 emits light in response to a voltage Vcc which is applied thereto by way of a resistor Ra. The first sensor 11A is provided with a light receiving element PT1 such as a phototransistor, etc. for receiving the reflecting light from the reference slight opaque portion 16. The light receiving element PT1 is connected in series with a variable resistor VR1 and a resistor Rb between a power supply and the ground. The receiving element PT1 outputs a current corresponding to the amount of light received thereby. The reference slight opaque portion detecting means 22 outputs a voltage as a detection voltage V1 which is generated by the current output from the light receiving element PT1 at a point a between the resistor Rb and the light receiving element PT1. On the other hand, the printing slight opaque portion detecting means 23 includes the second sensor 11B which is provided with a light emitting element LED2 such as a light emitting diode, etc. The light emitting element LED 2 emits light in response to a voltage Vcc which is applied thereto by way of a resistor Rc. The second sensor 11B is provided with a light receiving element PT 2 such as a phototransistor, etc. for receiving the reflecting light from the printing slight opaque portion. The light receiving element PT2 is connected in series with a variable resistor VR2 and a resistor Rd between a power supply and the ground. The receiving element PT2 outputs a current corresponding to the amount of light received thereby. The printing slight opaque portion detecting means 23 outputs a voltage as a detection voltage V2 which is generated by the current output from the light receiving element PT2 at a point b between the resistor Rd and the light receiving element PT2.

The variable resistors VR1 and VR2 in both circuits 22 and 23 are resistors to uniform the characteristics of the detection voltages output by the first and second sensors 11A and 11B.

The thermally reversible properties life judging means 24 comprises the differential amplifier 20, a threshold voltage generating circuit composed of a resistor Re and a variable resistor VR3, and the comparator 19. The differential amplifier 20 comprises an operational amplifier OP and resistors R1 to R4 connected thereto.

Suppose that the resistance values of the resistors R1 to R4 are R1=R3 and R2=R4, the amplification ratio of the differential amplifier 20 is expressed as R2/R1 (R2>R1).

If the differential amplifier 20 receives the detection voltage V1 from the reference slight opaque portion detecting means 22 by way of the resistor R1 while it receives the detection voltage V2 from the printing slight opaque portion detecting means 23 by way of the resistor R3, a voltage V3 output from the differential amplifier 20 is expressed in the following equation (1). That is, the differential amplifier 20 amplifies the difference between the detection voltages V1 and V2, which are input thereto in response to each reflectance of the reference and printing slight opaque portions, at the amplitude ratio of R2/R1 and outputs as the output voltage V3.

$$V3=(R2/R1)(V2-V1) \quad (1)$$

The threshold voltage generating circuit divides the power supply Vcc by the resistor Re and the variable resistor VR3 and generates a threshold voltage Vref.

The comparator 19 receives the output voltage V3 of the differential amplifier 20 at its noninverting input terminal and the threshold voltage Vref at its inverting input terminal and outputs an output signal Vout. The comparator 19 allows the output signal Vout to be "L", i.e. low level if the output voltage V3 is equal to or less than the threshold voltage Vref while it changes the output signal Vout to "H", i.e. high level if the output voltage V3 is greater than the threshold voltage Vref.

The threshold voltage Vref is set to be equal to the value of the voltage V3 output from the differential amplifier 20 when the printing slight opaque portion has the value of e.g. 0.59 in the O.D. in the last stage of use of the card. The threshold voltage Vref is regulated by the variable resistor VR3.

If the threshold value is set as set forth above, the life of the thermally reversible thermosensitive recording material can be verified when the output signal digitized by the comparator 19 is changed to "H". Accordingly, the thermally reversible properties life judging means 24 outputs the output signal Vout as the life judging signal.

Figure 6:
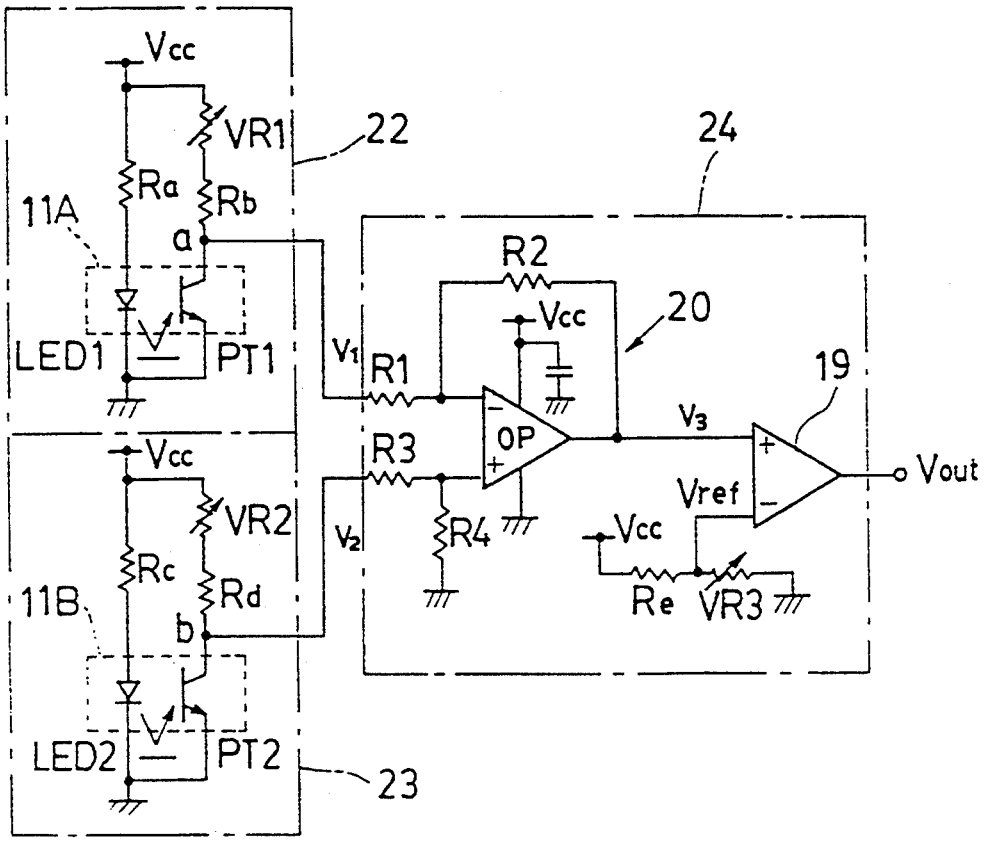
FIG. 6 is an electric circuit diagram showing the arrangement of the thermally reversible properties life judging means of FIG. 5.
Figure 7A:
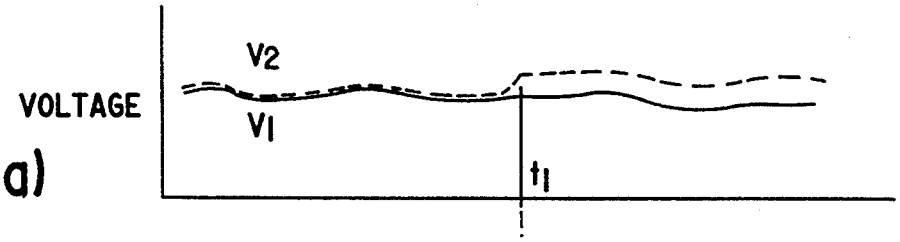
FIGS. 7(*a*) to 7(*c*) are views showing waveforms of voltage and an output signal of each component of the electric circuit of FIG. 6.
Figure 7B:
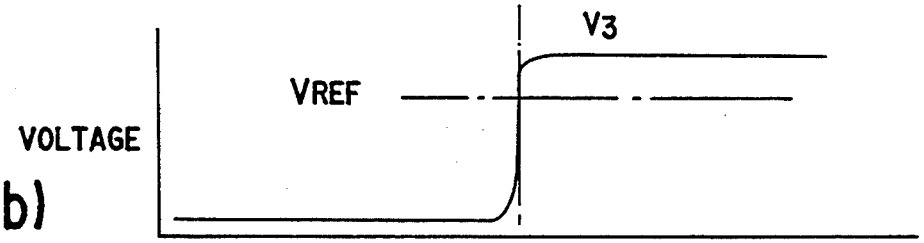
Figure 7C:
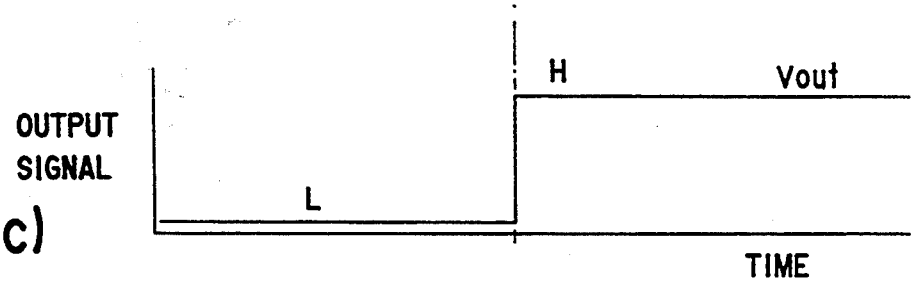

FIGS. 7(*a*) to 7(*c*) are views showing waveforms of voltages and an output signal of each component of the electric circuit of FIG. 6.

The distance between the first sensor 11A and the reference slight opaque portion 16 and the distance between the second sensor **11*b*** and the printing slight opaque portion are varied depending on the bending of the card or the variation of the ambient temperature. However, as illustrated in FIG. 7(*a*), the detection voltage V1 output from the reference slight opaque portion detecting circuit 22 by the operation of the first sensor 11A and the detection voltage V2 output from the printing slight opaque portion detecting circuit 23 by the operation of the second sensor 11B are respectively varied in response to the variation of the bending of the card or the variation of the ambient temperature. Accordingly, the voltage V3 output from the differential amplifier 20 is not varied as illustrated in FIG. 7(*b*).

If there appears the difference between the detection voltages 1 and V2, the difference is amplified large so that the voltage V3 is increased. If the voltage V3 exceeds the threshold voltage Vref, the output of the comparator 19, i.e. the life judging signal Vout is changed to "H" as illustrated in FIG. 7(*c*). The life judging signal Vout is applied to the main control portion 40, described later.

The printing apparatus of the invention is such structured that it judges that a bar code reader can or can not read the printed information such as a bar code, etc. printed on the card C and verifies by a verification means (FIG. 13) that the data information is correctly printed or not.

That is, there is a possibility that the bar code reader can not read the printed bar code if the printed information such as the bar code has a defect such as a flaw or the contrast ratio to the base color is decreased because of the reduction of the density of slight opacity of the printing slight opaque portion. The verification means 70 prevents the inferior card from being issued and comprises the verification unit 12, a data processing portion 53 and the bar code verification control portion 44 as illustrated in FIG. 13.

The verification unit 12 comprises a reflecting plate 39, an LED array 37, a lens 51 and a CCD line image sensor (hereinafter referred to as "CCD") 52 wherein the reflecting plate 39 reflects the light emitted from the LED array 37 toward the printed portion such as the bar code 38 and the CCD 52 receives the reflected light by way of the a lens 51 and performs an optical/electrical conversion to thereby issue an analog signal for each pixel to the data processing portion 53.

Figure 13:
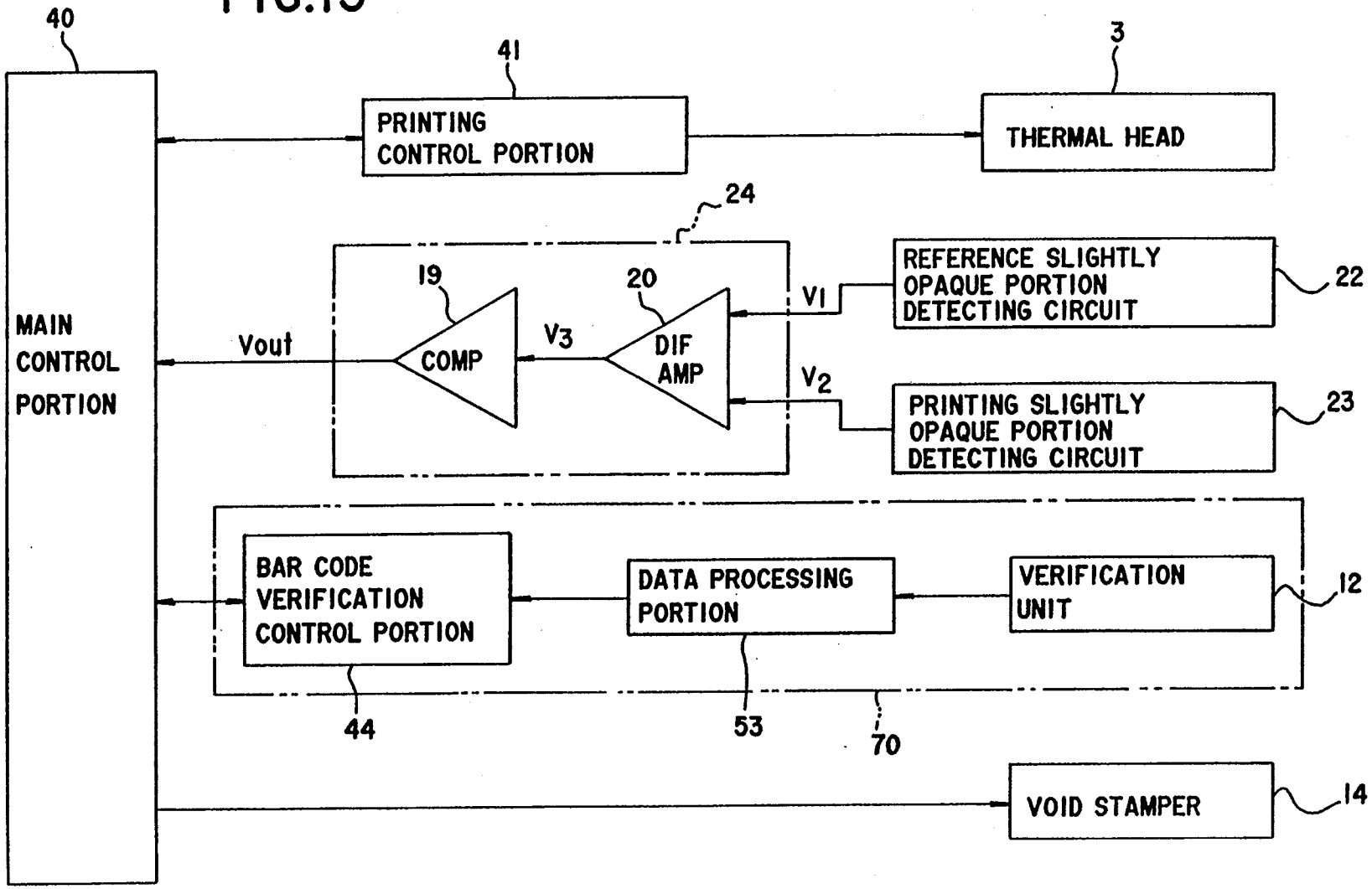
FIG. 13 is a block diagram showing a control system of the printing apparatus of FIG. 1.

The data processing portion 53 digitizes the input information and the digitized information is supplied to the bar code verification control portion 44 (FIG. 13). The bar code verification control portion 44 decodes the information supplied from the data processing portion 53 and collates the decoded information with a reference information (data information to be printed) and thereafter verifies that the input information is a flawless information which can be read by the reader, i.e. normal printed information.

The bar code 38 which was judged as normal as a result of verification can be read by the bar code reader, the printing apparatus sends the card to the discharge tray as it is. If the card is judged as the inferior card having a flaw on the bar code 38 as a result of verification, the printing apparatus operates the void stamper 14 as illustrated in FIG. 1 in a given timing so that the invalid index is formed on the card and the printing apparatus sends the inferior card to the discharge tray.

The verification means 70 may comprise a carriage 55 on which a pen type scanner 54 is mounted and a guide shaft 56 extending from the carriage 55 wherein the carriage 55 is moved along the guide shaft 56, thereby reading the bar code 38.

Figure 11:
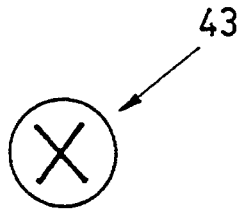
FIG. 11 is a plan view showing an example of the invalid index printed on the rewriteable card by the invalid index forming means of FIG. 10.

The printing apparatus of the invention is also provided with the void stamper 14 serving as an invalid index forming means which forms an invalid index 43 as illustrated in FIG. 11 on the card, the life of which is judged to have expired by the thermally reversible properties life judging means 24.

Figure 10:
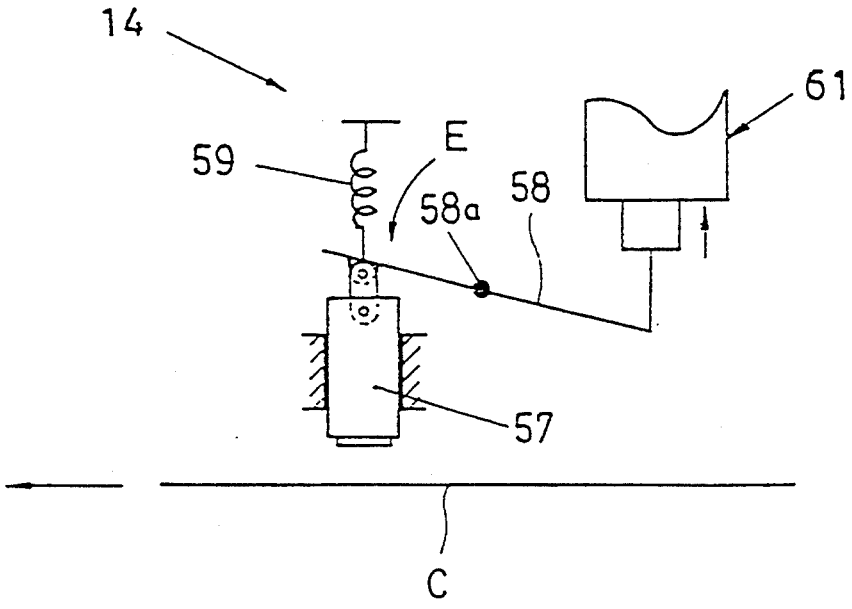
FIG. 10 is a perspective view showing the arrangement of an invalid index forming means of the printing apparatus of FIG. 1.

The void stamper 14 is exemplified in FIG. 10 and comprises a stamper 57 which automatically supplies ink and is connected to one end of a swing member 58 and supported thereby so as to be movable to and away form the card C, the swing member 58 being connected at the other end to a solenoid 61 wherein the swing member 58 is swingably supported by a fulcrum **58*a* positioned at the center thereof, a spring 59 connected to one end of the stamper 57 for always biasing the stamper 57 in the direction to move the stamper 57 away from the card C. When the solenoid 61 is energized, the swing member 58 swings in the direction of the arrow E whereby the stamper 57** lowers and stamps the invalid index on the upper surface of the card C.

Figure 12:
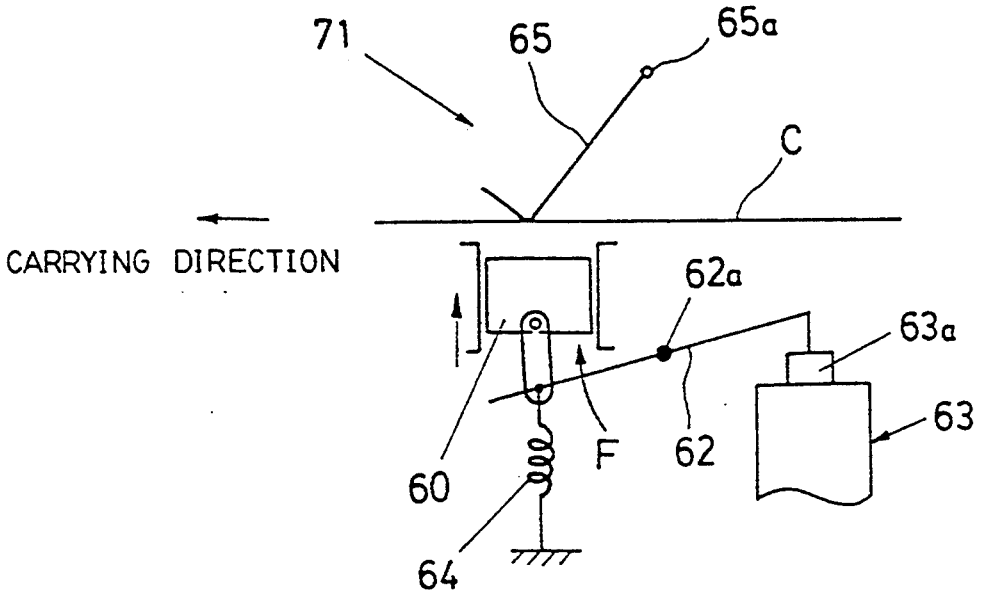
FIG. 12 is a perspective view showing the arrangement of another invalid index forming means according to the embodiment of the invention.

Another invalid index forming means 71 may be provided instead of the void stamper 14 as illustrated in FIG. 12. The invalid index forming means comprises a heater 60 confronting the portion on the card where the index mark is to be stamped, a swing member 62 having one end connected to the heater 60 and the other end connected to the movable shaft 63*a* of a solenoid 63 wherein the swing member 62 is swingably supported by a fulcrum 62*a* positioned at the center thereof.

When the solenoid 63 is energized, the swing member 62 swings in the direction of the arrow F so that the heater 60 moves upward to thereby touch the lower surface of the card C. At the same time, the heater 60 is heated to the temperature where the thermally reversible thermosensitive recording material changes to transparency so that the printing slight opaque portion of the card C is changed to the transparent state. Alternatively, the heater 60 is heated to the temperature where the thermally reversible thermosensitive recording material changes to slight opacity so that the transparent portion of the card C is changed to the slight opaque state. Especially, in case that the transparent portion of the thermally reversible thermosensitive recording material occupies a large area, the slight opaque portion formed in the transparent region is liable to leap to our eye, which is effective as the invalid index.

In such a manner, if the invalid index is formed utilizing the change to the slight opacity or the transparency of the thermally reversible thermosensitive recording material by the heating of the card, it is possible to reconfirm that the card can be practically recycled or not by reheating the inferior card to thereby erase all the printed information and the invalid indexes thereafter reprinting the inferior card. In such a case, the temperature to which the thermally reversible thermosensitive recording material changes to the transparent state or the slight opaque state is beforehand input to the main control portion 40 (FIG. 13) and the heater 60 may be controlled based on the information, i.e. temperature stored in the main control portion 40.

If the solenoid 63 is deenergized, the swing member 62 swings by the biasing force of a spring 64 connected thereto so as to move the heater 60 away from the card C. A presser plate 65 is provided opposite to the heater 60 for pressing the card C, which improves adhesion between the card C and the heater 60. If the shape of the contact portion between the heater 60 and the card C is circular when the heater 60 contacts the card C while the latter travels on the carriage route 21, the invalid index, i.e. the shape of the portion, which changed to transparent state or the slight opaque state by heating, changes to an elliptic shape in the carrying direction.

The invalid index forming means operates to form an invalid index even on the card which was judged as a defecting inferior card by the verification means 70 (FIG. 13) as a result of verification thereof.

FIG. 13 is a block diagram showing a control system of the printing apparatus of the invention.

The information to be printed on the card C is output from the main control portion 40 and input to the thermal head 3 by way of a printing control portion 41. The thermal head 3 prints the data information output from the printing control portion 41 on the card while it is driven by a thermal head driver, not shown.

The reference slightly opaque portion detecting circuit 22 and the printing slightly opaque portion detecting circuit 23 output the detection voltages V1 and V2 corresponding to each reflectance of the reference slight opaque portion and the printing slight opaque portion on the card C and these detection voltages V1 and V2 are input to the differential amplifier 20. The differential amplifier 20 amplifies the difference between these input detection voltages V1 and V2 and outputs the output voltage V3 which is applied to the comparator 19. The comparator 19 digitizes the output voltage V3 based on the predetermined threshold voltage Vref and outputs the life judging signal Vout which is applied to the main control portion 40.

The main control portion 40 controls the printing means and the invalid index forming means, etc. based on the levels of the life judging signal Vout.

Figure 8:
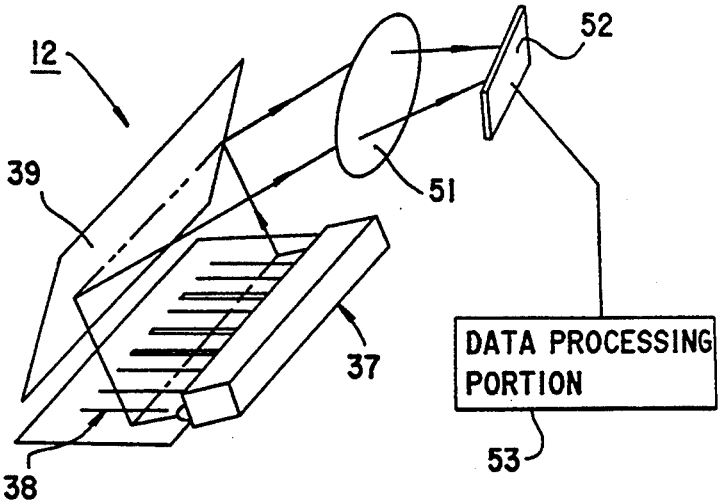
FIG. 8 is a perspective view showing the arrangement of a verification unit of the printing apparatus of FIG. 1.
Figure 9:
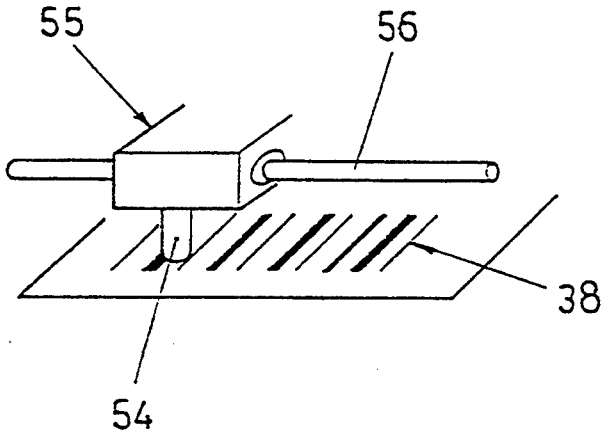
FIG. 9 is a perspective view showing the arrangement of another verification unit according to the embodiment of the invention.

An image signal such as the bar code, etc. printed on the card C is supplied from the CCD 52 (FIG. 8) of the verification unit 12 to the bar code verification control portion 44 by way of the data processing portion 53. The bar code verification control portion 44 receives an information which bases the verification from the main control portion 40 and verifies that the input image signal is a flawless printed information or not based on the information from the main control portion 40. If the printed information is defective, the void stamper 14 is driven by way of a void stamper driver, not shown, to thereby form the invalid index on the card C.

Described hereinafter is how the invalid index is formed depending on the printed information.

Described first is the case where the printed information can be seen and confirmed by the human eyes. In this case, since the printed information is judged by the human eyes, the life of the card may be judged by people. However, it is very troublesome for the people to judge the life of the card every time they see the card, which is not effective.

In such a case, the printing apparatus of the invention is effective. That is, the slight opaque state at the last stage of the use of the card which is confirmed by the human eyes are set as the reference slight opaque portion 16 as described in FIG. 5. If the density of slight opacity of the printing slight opaque portion on the card is lower than that of the reference slight opaque portion 16, it is judged that the life of the card had expired and the invalid index is formed on the card C as explained with reference to FIGS. 10 and 12. By this, the inferior cards are sorted from the normal cards by mere confirmation of the invalid indexes.

In case that the printed information includes the one such as the bar code, etc. which can be read using an electro-optical reader, the invalid index may be formed on the card which was judged as the inferior card as a result of verification of the bar code, etc. by the verification means 70.

Meanwhile there are roughly two factors based on which the card is judged as the inferior card as a result of verification by the verification means 70.

(1) First factor is the case where the printed information can not be recognized when some dots are lost or the void spot is generated on the bar code or the card has a flaw on its surface.

(2) Second factor is the case where the print contrast signal value of the printing slight opaque portion is lowered so that the printed information can not be read out.

The print contrast signal value is a value representing the contrast which is expressed as follows.

$$PCS\ \text{value} = \{(Rs - RB)/Rs\} \times 100\ (\%) \qquad (2)$$

where Rs is a reflectance of the space (slight opaque portion) between the bars of the bar code and RB is reflectance of the bar.

It is possible to judge either of the factors based on which the card is judged as the inferior card is caused by the following manner.

That is, there is a possibility of the first factor (1) as set forth above in case that the card is judged as the normal one as a result of judgment by the thermally reversible properties life judging means 24 although the card is judged as the inferior one as a result of verification by the verification means 70. On the other hand, if the card is judged as the inferior one as the result of verification by the verification means 70 and the result of judgment by the thermally reversible properties life judging means 24, there is a possibility of the second factor (2) as set forth above.

Accordingly, if the indexes are differentiated from each other in both cases, for example, if a single invalid index is printed on the card in the former case while if two invalid indexes are printed on the card in the latter case, the factors based on which the card is judged as the inferior one can be easily confirmed by the mode of the invalid index, which enables the operator to easily sort the invalid card from the normal card.

The printing apparatus of the invention is provided with an invalid index changing control means for changing the mode of the invalid index depending on the factors based on which the card is judged as the inferior one and forming the corresponding invalid indexes. Concretely, the main control portion 40 using a microcomputer serves as the invalid index changing control means as illustrated in FIG. 13.

Table 1 shows the condition of the card based on the combination of the result of judgment by the thermally reversible properties life judging means and the result of verification by the verification means.

TABLE 1

| Judgment of the thermally reversible properties life judging means | Judgment of the verification means | Condition of the card |
|---|---|---|
| OK | OK | No problem |
| NG | OK | Card is soon expired but bar code can be read |
| OK | NG | Card is living but bar code is defective |
| NG | NG | Card can not be used since it has expired |

As is shown in Table 1, if the thermally reversible properties life judging means 24 judges that the card is inferior but the verification means 70 judges that the card is normal, the card is soon expired where the card per se can not be read by the reader such as a card reader but at present the card can be read by the reader. As a result, the card can be continuously used.

If both the thermally reversible properties life judging means 24 and the verification means 70 judge that the card is inferior, it is conjectured that a given PCS value can not be obtained at the printing slight opaque portion. As a result, it is judged that the card has expired in its natural term of life.

The degree of slight opacity of the reference slight opaque portion 16 to be formed on the card needs to be differentiated depending on the presence or absence of the bar code.

That is, in case of the absence of the bar code, the card can be used even if the contrast ratio between the slight opaque portion and the transparent base color portion is tolerably decreased since the card can be confirmed externally by the human eyes. In such a manner, the degree of slight opacity of the reference slight opaque portion 16 can be decided appropriately depending on the printed information of the card to be used.

The printing apparatus of the invention is further provided with a reprinting control means for controlling the printing means so that the printing means prints the same printed information having been printed on the inferior card on the card which is carried next thereto to be printed, when the verification means 70 detected the inferior card having the defective printed information. Concretely, the main control portion 40 as illustrated in FIG. 13 serves as the reprinting control means, which dispenses with the troublesome work by the operator involved in preparation of a fresh card having the same printed information as the inferior card upon completion of a series of printing operations.

The reprinting control means (main control portion 40) controls the printing means so that the printing means prints the same printed information having been printed on the inferior card on the card which is carried next thereto to be printed, even if the thermally reversible properties life judging means 24 judges that the card does not stand use because of the degradation with respect to its thermal reversible properties.

If the inferior cards are successively issued in the predetermined number, it is preferable to issue an operator call and stop all the operations of the printing apparatus recognizing that the thermal head 3 is broken or troubled by some reasons or there are many cards which have expired and need to be replaced by new cards. As a result, it is possible to prevent a large number of inferior cards from being issued.

A modification of the invention will be described hereinafter.

The modification of the invention is structured that the final life of the card is judged considering the result of judgment by the thermally reversible properties life judging means 24 and the result of verification by the verification means.

That is, the life of the thermally reversible properties of the thermally reversible thermosensitive recording material used as the card is varied depending on the kind of card. Accordingly, in case of judging that the thermally reversible thermosensitive recording material has expired or not, there is a left margin in the criterion of judgment of life. If the life of the card is judged based on the uniform criterion which is set to the side where the term of life is shortened, even if the card is judged to have expired, there is a possibility that the printed information such as the bar code can be read by the bar code reader so that the card can be used without any obstacle.

According to the printing apparatus of the invention, the main control portion 40 serves as a card life deciding means has a function to decide the life of the card so as to decide the life of the card based on the result of judgment by the thermally reversible properties life judging means 24 and the result of verification by the verification means 70.

The card life deciding means judges that the card can be used in case that the verification means 70 did not detect the printed information even if the thermally reversible properties life judging means 24 judged that the thermally reversible thermosensitive recording material had expired in its thermally reversible properties.

Furthermore, if the thermally reversible properties life judging means 24 judged that the thermally reversible thermosensitive recording material had expired in its thermally reversible properties and the verification means 70 judged that the card was defective, it is judged that the card expired in its natural term of life.

According to the printing apparatus of the invention, it is possible to judge the life of card effectively since the final life of the card can be judged considering the result of judgment by the thermally reversible properties life judging means 24 and the result of verification by the verification means 70. In such a manner, the margin left on the life of the card is utilized, which advantage the user's use of the card.

The card life deciding means (main control portion 40) controls the invalid index forming means based on the result of the judgment of the life of the card. That is, if the life deciding means judges that the card has expired in its natural life, it controls the invalid index forming means to form the invalid index on the card. In this case, it is possible to inform accurately the operator of the mode of the card as shown in Table 1 if the mode of the invalid index is changed by the invalid index changing means by dividing the causes of generation of the inferior card in various cases, namely, into a case where the card is judged inferior based on the result of judgment by the thermally reversible properties life judging means 24, another case where the card is judged inferior based on the result of verification by the verification means 70 or further case where the card is judged inferior based on both the results.

The card life deciding means supplies the result of judgment pertaining to the life of the card to the reprinting control means. The reprinting control means controls the printing means so that the latter prints the same printed information as that of the card which have expired on the card which is carried next to be printed.

Described above is the case where appropriate heat energies are applied to the card by the thermal head serving as the printing means whereby the card is heated to the prescribed heat energies to thereby allow the card to be slight opaque. However, the invention is applied to the case where the card is first heated to the printing temperature by the constant temperature tank, etc. to thereby allow the entire card to be slight opaque, thereafter the appropriate heat energies corresponding to the erasing temperature are applied to the card by the thermal head to thereby allow the card to be transparent. This shows that the properties pertaining to the life of the thermally reversible thermosensitive recording material is caused by the lowering of the density of slight opacity.

Furthermore utilizing the concept of the invention, it is possible to judge the life of the thermally reversible properties of the thermally reversible thermosensitive recording material used as the rewriteable card in case the properties pertaining to the life of the thermally reversible thermosensitive recording material is caused by the lowering of the density of transparency of the transparent portion. In this case, the reflectance of the transparent portion (printing transparent portion) may be compared with the reflectance of the portion other than the printing portion on the rewriteable card or with the reflectance of the reference transparent portion. The printing transparent portion corresponds to the printing slight opaque portion and the reference transparent portion corresponds to the reference slight opaque portion as set forth in the preferred embodiment. Accordingly, the reference transparent portion needs to have the reflectance equivalent to that of the thermally reversible thermosensitive recording material at the early stage or the last stage of use of the rewriteable card.

What is claimed is:

1. A method of judging life of a rewriteable card composed of a thermally reversible thermosensitive recording material which changes reversibly between a slightly opaque state and a transparent state depending on a given heating condition, the method comprising the steps of:

providing a rewriteable card composed of a thermally reversible thermosensitive recording material which changes reversibly between a slightly opaque state and a transparent state depending on a given heating condition;

detecting reflectance of a reference slightly opaque portion representing slight opacity of said rewriteable card in an early or last stage of use of said rewriteable card;

detecting reflectance of a printing slightly opaque portion which is made slightly opaque when appropriate heat energies are applied to said rewriteable card;

comparing said reflectance of said reference slightly opaque portion representing slight opacity of said rewriteable card in said early or last stage of use of said rewriteable card with that of said printing slightly opaque portion which is made slightly opaque when appropriate heat energies are applied to said rewriteable card to thereby judge life of thermally reversible properties of said thermally reversible thermosensitive recording material.

2. A method according to claim 1 further comprising the steps of verifying whether data information printed on said rewriteable card has a defect or not, and detecting a defect of said data information printed on said rewriteable card, whereby when the life of said thermally reversible properties is judged to be over, and a defect of said data information is detected, then the life of said rewriteable card is judged to have expired.

* * * * *